US005206080A

United States Patent [19]

Tashiro et al.

[11] Patent Number: 5,206,080

[45] Date of Patent: Apr. 27, 1993

[54] FRAGRANT NON-HOLLOW CORE-IN-SHEATH TYPE COMPOSITE STAPLE FIBER AND TEXTILE MATERIAL CONTAINING SAME

[75] Inventors: Mikio Tashiro, Matsuyama; Tetsuya Hongu, Tokuyama; Kazunori Orii, Kasatsu, all of Japan

[73] Assignee: Tree Extracts Research Association, Tokyo, Japan

[21] Appl. No.: 831,864

[22] Filed: Feb. 5, 1992

[30] Foreign Application Priority Data

| | | | |
|---|---|---|---|
| Feb. 13, 1991 | [JP] | Japan | 3-40535 |
| Feb. 13, 1991 | [JP] | Japan | 3-40537 |
| Feb. 20, 1991 | [JP] | Japan | 3-45682 |

[51] Int. Cl.[5] ..... D02G 3/00; B32B 7/00; D04B 1/00

[52] U.S. Cl. ..... 428/253; 428/272; 428/365; 428/370; 428/373; 428/905

[58] Field of Search ..... 428/373, 905, 365, 253, 428/272, 370

[56] References Cited

U.S. PATENT DOCUMENTS

| | | | |
|---|---|---|---|
| 3,919,091 | 11/1975 | Eckert et al. | 428/272 |
| 4,713,291 | 12/1987 | Sasaki et al. | 428/373 |
| 4,917,920 | 4/1990 | Ono et al. | 428/905 |

FOREIGN PATENT DOCUMENTS

| | | | |
|---|---|---|---|
| 0093714 | 12/1973 | Japan . | |
| 1201013 | 9/1986 | Japan | 428/373 |
| 2085010 | 4/1987 | Japan | 428/373 |
| 1280068 | 11/1989 | Japan | 428/373 |
| 2221468 | 9/1990 | Japan | 428/905 |

*Primary Examiner*—George F. Lesmes
*Assistant Examiner*—Terrel Morris
*Attorney, Agent, or Firm*—Burgess, Ryan & Wayne

[57] ABSTRACT

A fragrant non-hollow core-in-sheath type composite staple fiber having a length of from 3 mm to 150 mm and useful for gradual fragrance-emitting textile materials comprises (1) a non-hollow core portion comprising (i) 0.1 to 5% of an essential oil and (ii) the balance consisting of an olefin polymer composition; and (2) a sheath portion covering the core portion and comprising a polyester resin, the olefin polymer composition (ii) comprising: (A) 50 to 98% by weight of an olefin polymer which is a polymerization product of at least one member selected from ethylene and α-olefins, and free from polar radicals; and (B) 2 to 50% by weight of a modified olefin polymer that is a copolymerization product of (a) 70 to 97% by weight of at least one olefin with (b) 3 to 30% by weight of at least one ethylenically unsaturated polar monomer selected from ethylenically unsaturated carboxylic acids, ethylenically unsaturated alcohols, ethylenically unsaturated esters, anhydrides and amides of the above-mentioned carboxylic acids and uniformly blended with the olefin polymer (A).

16 Claims, No Drawings

FRAGRANT NON-HOLLOW CORE-IN-SHEATH TYPE COMPOSITE STAPLE FIBER AND TEXTILE MATERIAL CONTAINING SAME

BACKGROUND OF THE INVENTION

1. Field of the Invention

The present invention relates to a fragrant non-hollow core-in-sheath type composite staple fiber and a gradual fragrance-emitting textile material containing same. More particularly, the present invention relates to a fragrant non-hollow core-in-sheath type composite staple fiber in which a non-hollow core portion thereof contains an essential oil and is covered by a sheath portion, and accordingly, a fragrance is gradually emitted through cut end faces of the core portion over a long time, and which provides an atmosphere reminiscent of a forest and has a refreshing effect, and a gradual fragrance-emitting textile material containing same.

2. Description of the Related Arts

Hinoki wood (timber) has been used to form pillars or the flooring of a house, and the specific fragrance of the Hinoki wood has a calming effect on people living in the house and provides an atmosphere reminiscent of a forest within the house. Nevertheless, the effect of the fragrant substance in the Hinoki wood becomes weaker with an elapse of time, and thus it is difficult to maintain the fragrant effect thereof at a satisfactory level for a long time.

Accordingly, various attempts have been made to obtain the atmosphere of a forest in a house, by applying an essence of natural essential oils to bedclothes, furnishings, and interior materials. For example, attempts have been made to adhere an essential oil to clothes or to cause the essential oil to be adsorbed by clothes, by a finishing process. This attempt is disadvantageous, however, in that the essential oil is easily removed from the clothes by water-rinsing or laundering, or due to a rapid vaporization thereof, and thus the durability of the fragrant effect is unsatisfactory.

Japanese Unexamined Patent Publication No. 61-201012 discloses a hollow core-in-sheath type composite fiber in which a member selected from natural essential oils, and fragrant essences extracted from the oils, is contained in the core portion thereof. Also, Japanese Unexamined Patent Publication No. 62-85010 discloses a hollow multiple cores-in-sheath type composite fiber in which the fragrant substance is contained in the multiple core portions.

The above-mentioned conventional hollow composite fibers, however, have an unsatisfactory durability of the fragrant effect thereof. Also, the hollow composite fibers are disadvantageous in that, since each core portion composed of an olefin polymer has a filamentary hollow extending along the longitudinal axis of the fiber, when a pressure is applied to the peripheries of the hollow composite fibers, the hollow composite fibers are flattened by squeezing the hollows, and thus exhibit a reduced bulkiness. Accordingly, when the hollow composite fibers are used as a wadding material for a mattress, pillow, cushion or stuffed toy, which are frequently compressed under a high compressive load, the bulkiness or elastic resistance to compression of the resultant material is difficult to maintain at a satisfactory level for a long time. In other attempts, Japanese Unexamined Patent Publication Nos. 1-260,066 and 1-266,201 disclose a fiber product having microcapsules containing therein a fragrant substance and adhered to a surface thereof through a binder material, and Japanese Unexamined Patent Publication No. 1-280068 discloses a composite fiber in which a fragrant substance-containing polymer is coated on an exposed outer surface portion thereof.

The fragrant microcapsule-containing fiber product is disadvantageous in that the fragrant microcapsules are easily removed from the fiber product surface, and thus the durability of the fragrant effect is unsatisfactory.

The composite fiber coated by the fragrant substance-containing polymer has a relatively large surface area in which the fragrant substance is located, and thus exhibits a very high fragrant effect at an initial stage of use. Nevertheless, this type of composite fiber is disadvantageous in that the strength of the fragrant substance is rapidly lowered due to a vaporization thereof on the large surface area of the fiber, and thus the durability of the fragrant effect is unsatisfactory.

SUMMARY OF THE INVENTION

An object of the present invention is to provide a fragrant non-hollow core-in-sheath type composite staple fiber having a fragrant effect thereof with a high durability, and a textile material containing same and capable of gradually emitting a fragrance for a long time.

The above-mentioned object can be attained by the fragrant non-hollow core-in-sheath type composite staple fiber of the present invention, which has a length of from 3 mm to 150 mm and comprises:

(1) a non-hollow core portion comprising (i) 0.1 to 5%, based on the total weight of the core portion, of an essential oil and (ii) the balance consisting of an olefin polymer composition; and (2) a sheath portion covering the core portion and comprising a polyester resin, the olefin polymer composition (ii) comprising:

(A) 50 to 98% by weight of an olefin polymer which is a polymerization product of at least one member selected from the group consisting of ethylene and α-olefins, and is free from polar radicals; and (B) 2 to 50% by weight of a modified olefin polymer, which is a copolymerization product of (a) 70 to 97% by weight of at least one olefin with (b) 3 to 30% by weight of at least one ethylenically unsaturated polar monomer selected from the group consisting of ethylenically unsaturated carboxylic acids, ethylenically unsaturated alcohols, esters of the above-mentioned carboxylic acids and alcohols and anhydrides and amides of the above-mentioned carboxylic acids, and is uniformly blended with the olefin polymer (A).

The gradual fragrance-emitting textile material of the present invention, for example, a fiber wadding, paper-like sheet or woven or knitted fabric, contains the above-mentioned fragrant non-hollow core-in-sheath type composite staple fiber.

DESCRIPTION OF THE PREFERRED EMBODIMENTS

In the fragrant composite staple fiber of the present invention, the core portion must be a non-hollow type comprising (i) 0.1 to 5%, based on the total weight of the core portion, of an essential oil, and (ii) the balance consisting of an olefin polymer composition comprising:

(A) 50 to 98% by weight of an olefin polymer composed of a polymerization product of at least one member selected from the group consisting of ethylene and α-olefins and free from polar radicals; and (B) 2 to 50% by weight of a modified olefin polymer composed of a copolymerization product of (a) 70 to 97% by weight of at least one olefin with (b) 3 to 30% by weight of at least one specific ethylenically unsaturated polar monomer, and covered with a sheath portion comprising a polyester resin.

The core portion of the composite staple fiber contains a fragrant substance consisting of an essential oil, especially a natural essential oil. For example, the essential oil comprises at least one member selected from the group consisting of Hinoki oil, peppermint oil, eucalyptus oil, Hiba oil and camphor oil. These natural essential oils are usually collected from branches, leaves, rootstocks, bark, fruit, seeds, buds, and resins of the corresponding plants, by steam distillation, and contain, as a principal component, a terpenoid.

It is very difficult for the terpenoid contained in the core portion to permeate through the polyester sheath portion covering the core portion, and thus be vaporized at the peripheral surface of the composite staple fiber.

The modified olefin polymer having polar radicals in the core portion has an appropriate affinity to the terpenoid, and thus can stably hold the essential oil therein. Also the olefin polymer free from the polar radical, contained in the core portion, has a poor affinity to the terpenoid, and thus allows the terpenoid to permeate therethrough at a certain permeation rate.

Accordingly, the permeation rate of the terpenoid through the core portion, and the vaporizing rate of the terpenoid at the cut end faces of the non-hollow core portion, can be controlled to appropriate levels by controlling the mixing ratio of the polar radical-free olefin polymer with the modified olefin polymer having the polar radicals in the specific range as defined in the present invention. Therefore, the intensity and durability of the fragrance of the composite staple fiber can be controlled to a desired level, in accordance with the present invention, to thereby maintain the fragrant effect, for example, forest atmospheric effect, for a long time.

In the composite staple fiber of the present invention, the essential oil is preferably contained in the core portion, but the core portion can contain an essential fragrant component isolated and refined from the essential oil. Also, the essential oil may be a synthetic essential oil. Preferably, the essential oil contains at least 30% by weight of at least one natural essential oil selected from Hinoki oil, peppermint oil, eucalyptus oil, and camphor oil. The above-mentioned natural essential oils exhibit a natural forest atmospheric effect, a comfortable sleeping effect, and a refreshing effect.

The essential oil is contained in an amount of 0.1 to 5% by weight, preferably 0.5 to 2% by weight in the core portion. If the essential oil content is less than 0.1% by weight, the resultant composite staple fiber cannot exhibit a satisfactory fragrant effect, for example, a forest atmospheric effect. Also, if the amount of the essential oil is more than 5% by weight, it becomes difficult to evenly dissolve and disperse the essential oil in the olefin polymer composition, and thus a melt-spinning procedure for the non-hollow core-in-sheath type composite fiber cannot be stably carried out. Also, the resultant composite staple fiber containing the essential oil in an excessively large content generates a strong smell which sometimes becomes unpleasant.

In the composite staple fiber of the present invention, the olefin polymer composition of the core portion comprises (A) 50 to 98% by weight, preferably 70 to 98% by weight of a specific olefin polymer free from polar radicals, for example, carboxyl, hydroxyl, ester, amide and acid anhydride radicals, and (B) 2 to 50% by weight, preferably 2 to 30% by weight of a specific modified olefin polymer having polar radicals.

If the content of the olefin polymer (A) is more than 98% by weight, the essential oil cannot be evenly dispersed in the resultant olefin polymer composition, and thus the melt-spinnability of the essential oil-containing olefin polymer composition becomes poor. Also, the essential oil is distributed in an increased concentration in the modified olefin polymer (B), because the olefin polymer (A) has a poor compatibility with the essential oil, and thus the essential oil is diffused at a high diffusion rate through the olefin polymer composition, and thus the durability of fragrance of the composite staple fiber is reduced.

If the content of the olefin polymer (A) is less than 50% by weight, the essential oil is distributed in a lowered concentration in the modified olefin polymer (B), which has a high compatibility with the essential oil, and thus the diffusion rate of the essential oil through the resultant olefin polymer composition of the core portion, and the fragrant effect of the resultant composite staple fiber, are lowered.

The olefin polymer (A) usable for the present invention is a polymerization product of at least one member selected from the group consisting of ethylene, and α-olefins, for example, propylene, butene-1 and hexene-1, and optionally, with at least one non-polar ethylenically unsaturated monomer in a small amount, preferably 10 molar % or less.

The non-polar ethylenically unsaturated monomer is selected from ethylenically unsaturated hydrorbon compounds free from polar radicals, for example, carboxylic, hydroxyl, ester, amide and acid anhydride radicals. The polar radical-free monomer is preferably selected from the group consisting of styrene and norbornadiene.

The modified olefin polymer (B) usable for the present invention is composed of a copolymerization product of (a) 70 to 97% by weight, preferably 80 to 95% by weight, of at least one olefin, for example, ethylene, propylene, butene-1 or hexene-1, with 3 to 30% by weight, preferably 5 to 20% by weight, of at least one ethylenically unsaturated polar monomer selected from the group consisting of ethylenically unsaturated carboxylic acids, for example, acrylic acid, methacrylic acid, maleic acid and fumaric acid, ethylenically unsaturated alcohols, for example, methallyl alcohol, ethylenically unsaturated esters, for example, lower alkyl esters of the above-mentioned unsaturated carboxylic acids, and vinyl acetate, anhydrides and amides of the above-mentioned carboxylic acids, for example, maleic anhydride.

When the content of the olefin (a) is more than 97% by weight and the content of the ethylenically unsaturated polar monomer (b) is less than 3% by weight, the resultant modified polymer (B) exhibits an unsatisfactory compatibility with the essential oil, and thus the durability of the fragrant effect of the resultant composite staple fiber becomes unsatisfactory. When the content of the olefin (a) is less than 70% by weight and the content of the ethylenically unsaturated polar monomer (b) is more than 30% by weight, the compatibility of the resultant modified olefin polymer (B) with the essential oil becomes too high, and thus the diffusion rate of the essential oil through the olefin polymer composition of the core portion becomes low and the resultant composite staple fiber exhibits an unsatisfactory fragrant effect.

Generally, the essential oil usable for the present invention exhibits a relatively low heat resistance and is relatively easily vaporized or decomposed by heating. Therefore, the olefin polymer composition of the core portion preferably has a relatively low melting or softening temperature. For example, the olefin polymer (A) preferably comprises at least one ethylene polymer, selected from the group consisting of high density polyethylenes, middle density polyethylenes and low density polyethylenes, and the modified olefin polymer (B) preferably comprises an ethylene-vinyl acetate copolymer.

In the composite staple fiber of the present invention, the sheath portion is composed of a polymeric material through which it is difficult for the essential oil to be diffused and permeated, and which is able to impart a high mechanical property to the resultant composite staple fiber. The sheath portion comprises a polyester, for example, polyethylene terephthalate resin comprising at least 95 molar % of ethylene terephthalate units and polybutylene terephthalate resin comprising at least 95 molar % of butylene terephthalate units. The sheath portion composed of the polyester is highly effective for imparting a high mechanical property to the resultant composite staple fiber and for preventing a spread of the essential oil therethrough.

In the composite staple fiber of the present invention, the core portion and the sheath portion are preferably in a weight ratio of from 80/20 to 20/80. If the core/-sheath weight ratio is more than 80/20, the formation of the core-in-sheath structure by a melt-spinning procedure becomes difficult, and sometimes the core portion is partly exposed to the outside, and thus the essential oil is spread to the outside at too high a spreading rate, and thus the durability of the fragrance thereof is lowered. Also, when the core/sheath weight ratio is less than 20/80, the resultant core portion has a very small end surface area, and thus the fragrance-spreading rate of the essential oil to the outside becomes too low and the fragrant effect of the resultant composite staple fiber is unsatisfactory.

The fragrant non-hollow core-in-sheath type composite staple fiber of the present invention can be produced by using a conventional core-in-sheath composite staple fiber-producing apparatus. Namely, an undrawn non-hollow core-in-sheath type composite filament is produced by a conventional melt-spinning process, and then drawn and cut to provide composite staple fibers.

In the melt-spinning process, the essential oil is adhered to the surfaces of the olefin polymer (A) chips or the modified olefin polymer (B) chips, and a blend of the olefin polymer (A) and the modified olefin polymer (B), containing the essential oil is supplied to the melt-spinning process. Alternatively, the essential oil is mixed into a melt of the modified olefin polymer (B), and then the essential oil-containing modified olefin polymer (B) is blended with the olefin polymer (A). This method is advantageous in that the essential oil is evenly distributed in the olefin polymer composition and the melt-spinnability of the olefin polymer composition is enhanced, and accordingly, the durability of the fragrance of the resultant composite staple fiber is improved.

In the above-mentioned melt-spinning process, since the essential oil, which may have a relatively low vaporizing temperature, is employed together with the modified olefin polymer (B) having a high compatibility with the essential oil, the essential oil is stabilized to an extend such that, while the core-forming polymer blend travels through a melt-spinning orifice block, a foaming of the resultant core portion due to a vaporization of the essential oil, does not occur. Also, when the core-in-sheath structure is formed by the melt-spinning procedure, the sheath portion is rapidly solidified, and thus the spread of the essential oil from the core portion can be prevented by the solidified sheath portion.

The melt-spun, undrawn composite filament is drawn, optionally crimped, and then finally cut to a length of from 3 mm to 150 mm, to thereby provide staple fibers.

When the length is less than 3 mm, the amount of the essential oil contained in an individual composite staple fiber is too small, and thus the durability of the fragrance of the resultant composite staple fiber becomes unsatisfactorily low.

When the length is more than 150 mm, the resultant composite staple fibers exhibit an unsatisfactory processability, for example, carding property and spinning property, and a poor bulkiness.

The composite staple fibers of the present invention preferably have a denier of 0.5 to 50, more preferably 3 to 20. When the denier is less than 0.5, the resultant composite staple fibers exhibit an unsatisfactory bulkiness and resiliency, whereas the softness thereof is high.

When the denier is more than 50, the resultant composite staple fibers exhibit an unsatisfactorily reduced bulkiness, although the resiliency thereof is high.

The length and denier of the composite staple fibers are set forth in consideration of the use thereof.

When used for a fiber wadding, for example, a filling of a bedding or cushion, the composite staple fibers preferably have a length of from 30 mm to 100 mm, more preferably from 40 mm to 70 mm, and a denier of 0.5 to 50, more preferably from 3 to 20.

When used for forming a paper-like sheet by a paper-forming method in which the composite staple fibers are suspended in an aqueous slurry, the composite staple fibers preferably have a length of 3 to 30 mm and a denier of 0.5 to 15. When the length is more than 30 mm, the uniform dispersion of the composite staple fibers in water becomes difficult.

When a woven or knitted fabric is made from spun yarns composed of the composite staple fibers of the present invention or a blend of the composite staple fibers of the present invention with another type of staple fibers, for example, natural fibers such as wool fibers or cotton fibers, semisynthetic fibers such as rayon fibers or synthetic fibers such as polyester, polyamide, or polyacrylonitrile fibers, the fragrant composite staple fibers preferably have a length of from 25 mm to 150 mm, more preferably 30 to 120 mm, and a denier of 0.5 to 50, more preferably 1.5 to 20.

When the fragrant composite staple fibers of the present invention are used for the wadding or the spun yarns, they are preferably crimped at a crimp number of 6 to 30 crimps/25 mm, more preferably 8 to 18 crimps/25 mm, in consideration of the carding property, bulkiness and resiliency required for the composite staple fibers. When the crimp number is more than 30 crimps/25 mm, the resultant web becomes uneven and the resultant wadding or spun yarns have undesirable neps.

When used for a paper-like sheet, preferably the composite staple fibers have substantially no crimp; when crimped, it is difficult to evenly disperse the resultant composite staple fibers in water.

As explained above, the fragrant core-in-sheath type composite staple fibers have no hollow in the core portions thereof. Also, the non-hollow core portion comprises (i) an essential oil and (ii) an olefin polymer composition comprising (A) an olefin polymer, which is free from polar radicals and thus allows the essential oil to diffuse through the core portion, and (B) a modified olefin polymer having a high affinity or compatibility with the essential oil.

In each core portion, the polar radical-free olefin polymer (A) serves as a permeation path for the essential oil, and the modified olefin polymer (B) serves as a storing place for the essential oil. Also, the essential oil-containing core portion is coated by the sheath portion comprising a polyester resin, which does not allow the essential oil to permeate therethrough.

Therefore, the fragrant component of the essential oil is allowed to volatilize toward the outside of the staple fiber only through the two end faces of the staple fiber. Accordingly, the fragrant non-hollow core-in-sheath type composite staple fibers can stably exhibit a fragrant effect, for example, an atmosphere reminiscent of a forest, for a long time.

The gradual fragrance-emitting textile material of the present invention contains at least 10% by weight, preferably 30 to 100% by weight of the above-mentioned fragrant non-hollow core-in-sheath type composite staple fibers.

The gradual fragrance-emitting textile material is preferably in the form of a fiber wadding, paper-like sheet or woven or knitted fabric.

When the content of the fragrant composite staple fibers is less than 10%, the resultant textile material has an unsatisfactory fragrance-emitting property.

The gradual fragrance-emitting textile material optionally contains 90% or less, preferably 70% or less, of additional staple fibers different from the fragrant composite staple fibers of the present invention.

The additional staple fibers are selected from natural fibers, for example, cotton, and wool fibers, regenerated fibers, for example, rayon fibers, semisynthetic fibers, for example, cellulose acetate fibers, and synthetic fibers, for example, polyester, polyamide, polyacrylonitrile and polyolefin fibers. Also, the fragrant composite staple fibers of the present invention is optionally mixed with down.

The mixing of the fragrant composite fibers and the additional staple fibers can be carried out at any stage in the production process of the textile material. For example, the fragrant composite fibers and the additional staple fibers can be mixed in the form of a fiber mass, card, web, sliver or yarn thereof.

When the fragrant composite staple fibers of the present invention is employed together with natural fibers such as cotton, wool or down fibers, the resultant textile material exhibits an adequate hygroscopicity, and thus is very comfortable when used.

When the polyester staple fibers are used together with the fragrant composite staple fibers, the resultant textile material exhibits an enhanced bulkiness and mechanical performance.

Also, where heat-bonding staple fibers are mixed with the fragrant composite staple fibers and the polyester fibers, the mixture is formed into a web or another form by, for example, a spraying method, and the resultant textile material is then heated so that the fragrant composite staple fibers and the polyester fibers are bonded to each other through the fused bonding fibers. The resultant textile material exhibits an excellent resilience and resistance to deformation and compression.

The additional staple fibers may be a mixture of two or more different types of staple fibers.

Usually, the heat-bonding staple fibers are contained in an amount of at least 10% by weight, preferably 10 to 50% by weight, in the fragrant textile material of the present invention.

When the content of the heat-bonding staple fibers is less than 10% by weight, the bonding effect of the staple fibers in the textile material is not sufficient to enhance the resiliency and resistance to deformation of the resultant textile material to a satisfactory level, but when this content is too high, the resultant textile material exhibits an excessively high stiffness.

The heat-bonding staple fibers preferably have a denier of 0.5 to 50, which is large enough to impart a satisfactory bulkiness and bonding strength to the resultant textile material, and a length of from 30 to 100 mm, which is long enough to cause the resultant fiber mixture to exhibit a satisfactory card-forming property and the resultant textile material to exhibit a satisfactory bonding strength.

The heat-bonding operation is carried out by a conventional method, for example, by heating the heat-bonding fiber-containing textile material, for example, a card, at a temperature higher than the melting or softening temperature of the heat-bonding fibers, for example, 100° C. to 240° C., by blowing hot air toward the textile material for 10 seconds to 20 minutes.

The heat-bonding staple fibers are preferably selected from synthetic polymer staple fibers having a low melting or softening temperature of from 60° to 200° C., for example, polyolefin fibers such as polyethylene fibers, polypropylene fibers, copolyester fibers, copolyamide fibers, polyurethane fibers. The copolyester fibers can be obtained at a relatively low price and are advantageous in that the resultant textile material has a high bulkiness and resistance to compression.

The heat-bonding fibers may be composite fibers comprising a high melting temperature polymer and a low melting temperature polymer having a melting point of 20° C. or more lower than that of the high melting temperature polymer. The high melting temperature polymer is preferably a polyester. This type of heat-bonding composite fibers is useful for producing a fragrant textile material having a relatively high bulkiness and compression resistance. Preferably, the weight ratio of the low melting temperature polymer to the high melting temperature polymer in the heat-bonding composite fibers is from 20/80 to 80/20, more preferably 40/60 to 60/40.

The fragrant composite staple fibers of the present invention can be contained in a cover cloth of a fiber wadding. In this case, the cover cloth can be made from a spun yarn comprising the fragrant composite staple fibers and other staple fibers, for example, cotton, wool, rayon or synthetic polymer fibers, for example, polyester fibers. The content of the fragrant composite staple fibers is preferably 5% by weight or more, more preferably 10% by weight or more. Also, the fiber wadding covered by the cover cloth may contain the fragrant composite staple fibers.

As long as the resultant fiber-wadded article contains the fragrant composite staple fibers in an amount of 10% by weight or more, the fragrant composite staple fibers are contained only in the cover cloth or the fiber wadding, or in both the cover cloth and the fiber wadding.

When the fiber-wadded article is a quilted article, the use of the fragrant composite staple fibers of the present invention effectively provides a gradual fragrance-emission during the wearing thereof.

In the preparation of the fiber-wadded article, the fiber wadding in the form of an opened fiber mass, a web, or a multiple-layer web in which two or more fiber layers having a different or the same type of fibers or composition of the fibers as each other, are superimposed one on the other, or a core made from a polyurethane foam, or rubber, in the form of a lump or sheet is covered with or superimposed on the above-mentioned fiber web, it is covered with the cover cloth by a conventional wadding method. The stiffness, cushioning property, draping property and resistance to compression of the fiber-wadded article can be selected as desired.

Preferably, when the fragrant composite staple fiber is contained in the fiber wadding covered by the cover cloth, the durability of the fragrance of the resultant fiber-wadded article can be controlled by controlling the weave density of the cover cloth. The higher the weave density, the lower the air permeability of the cover cloth, and thus the higher the durability of fragrance of the resultant fiber-wadded article. Preferably, the cover cloth has an air permeability of 20 ml/cm$^2$·sec or less under the ambient atmospheric pressure.

The air permeability is determined in the following manner.

A specimen (15 cm×15 cm) of the cover cloth is fixed on a gas-permeability tester having several air-sucking holes, in such a manner that the specimen covers one of the air-sucking holes. The air-sucking hole is connected to an air-sucking pump through a pressure-controller, an inclined barometer, and a vertical type barometer.

The pressure at the inclined barometer is controlled to a level of 0.5 atmosphere by using the pressure controller. If the pressure at the vertical type barometer is too low or too high, the specimen is fixed to another air-sucking hole by which the sucking pressure at the inclined barometer is made 0.5 atmosphere. When the inclined barometer indicates a pressure of 0.5 atmosphere, the pressure on the vertical type barometer is recorded, and from the diameter of the hole and the recorded pressure, the air-permeability in the unit of ml/cm$^2$·sec of the specimen is calculated.

The above-mentioned test operation is repeated on five specimens, and the air-permeability of the cover cloth is indicated by an average of the calculated values obtained from the five specimens. The fragrant non-hollow core-in-sheath type composite staple fibers can be converted to a spun yarn by a usual staple fiber-spinning method or a stretch-cut type tow-spinning method.

Also, the fragrant non-hollow core-in-sheath type composite staple fibers can be converted to a paper-like synthetic sheet by a conventional wet paper-forming method or a dry sheet-forming method.

The fragrant composite staple fibers of the present invention can be blended with other staple fibers, for example, natural fibers such as cotton or wool fibers, to provide a textile material having an improved hygroscopicity and comfort. Also, the fragrant composite staple fibers of the present invention may be mixed with heat-bonding staple fibers to provide a heat-bondable textile material having an improved resilience and bulkiness retention.

Accordingly, the fragrant non-hollow core-in-sheath type composite staple fibers of the present invention are useful for producing various textile materials, for example, wadding materials, thick bedquilts, pillows, sleeping bags, cushions, stuffed toys, winter clothes, ski wears, bed clothes, and textile materials for house interiors and car interiors, which can maintain a fragrant effect, for example, a forest atmospheric effect, for a long time.

Also, as mentioned above, the hygroscopicity, comfort, resilience, and bulkiness retention of the fragrant textile materials can be enhanced by blending the fragrant composite staple fibers with other functional staple fibers.

Also, the essential oils, especially Hinoki wood essential oil, has a high acaricide (acarus-avoiding) effect, and thus the fragrant textile materials of the present invention, for example, thick bedquilts and interior materials, exhibit an acaricide (acarus-avoiding) effect.

When the fragrant composite staple fibers of the present invention are converted to spun yarns, and the spun yarns are converted to a woven or knitted fabrics, the resultant fragrant fabrics can be used for producing curtains, surface clothes of stuffed toys, cushions and furniture, seat coverings of chairs, cover clothes of bedquilts, bed sheets and other clothes, which can maintain the fragrant effect, for example, a forest atmospheric effect, for a long time.

When the fragrant paper-like sheets containing the fragrant composite staple fibers of the present invention are used as room interior materials, for example, wallpaper, sliding door (fusuma) paper or paper sliding doors, the resultant room can maintain a fragrant effect, for example, a forest atmospheric effect, for a long time.

EXAMPLES

The present invention will be further explained by the following examples.

In the examples, the following tests were carried out

1. Evaluation of fragrance

A specimen consisting of fragrant composite staple fibers was exposed to the ambient air atmosphere for a predetermined time, and then subjected to a fragrance evaluation.

Separately, non-cut fragrant composite filament tow produced in Example 1 were stored under a hermetically sealed condition.

When the specimen was subjected to the fragrance evaluation, the fragrant composite filament tow was cut to provide standard fragrant composite staple fibers.

The fragrance of the specimen was evaluated in the following five classes, by comparison with the fragrance of the standard staple fibers.

| Class | Evaluation |
|---|---|
| 5 | Substantially equal to the standard |
| 4 | Slightly weaker fragrance than the standard |
| 3 | Weaker fragrance than the standard |
| 2 | Much weaker fragrance than the standard |

-continued

| Class | Evaluation |
|---|---|
| 1 | No fragrance |

2. The bulkiness and specific volume of fiber mass were determined in accordance with Japanese Industrial Standard (JIS) L 1097.

3. The bulkiness retention was determined in the following manner.

Ten pieces of web shaped specimens were superimposed one on the other and left to stand for three months. The bulkiness retention of the specimen was calculated from the following equation:

$$\text{Bulkiness reduction (\%)} = \frac{(H_0 - H_1)}{H_0} \times 100$$

wherein $H_o$ represents a total height in mm of the superimposed ten specimens at the start of the test, and $H_1$ represents a total height in mm of the superimposed ten specimens three months after the start of the test.

4. The acaricide (acarus-avoiding) effect of textile material was evaluated in the following manner.

At an initial stage of a textile material used during the summer season in Japan, the number of acarids in an area of 30 cm×30 cm of the textile material was counted by using a microscope. This test was repeated two years after the first test.

When no acarid was formed, the tested textile material was evaluated as acarid-avoidable, and where one acarid or more were found, the tested textile material was evaluated as acarid-unavoidable.

EXAMPLE 1

Fragrant non-hollow core-in-sheath type composite staple fibers were produced in the following manner.

A blend of (1) 5 parts by weight of pellets consisting of 20% by weight of a Hinoki essential oil and 80% by weight of a ethylene-vinyl acetate copolymer of 84% by weight of ethylene with 16% by weight of vinyl acetate, with (2) 95 parts by weight of pellets consisting of a high density polyethylene having a melt flow index of 20, was prepared.

A non-hollow core-in-sheath type composite filaments were produced by a core-in-sheath type filament-melt spinning apparatus by forming the core portion from the pellet blend melted at a temperature of 250° C. and forming a sheath portion from a polyethylene terephthalate resin having an intrinsic viscosity of 0.64 determined in a concentration of 1.2 g/100 ml in o-chlorophenol solvent at a temperature of 35° C., and melted at a temperature of 280° C.

In the core-in-sheath type filament melt-spinning apparatus, the melt-spinneret had 80 spinning circular orifices each having an inside diameter of 0.3 mm.

The polyethylene blend and polyethylene terephthalate melts were extruded through the spinneret and taken up at a speed of 800 m/min. The core portion and the sheath portion had a weight ratio of 50:50. The resultant undrawn composite filaments were bundled to provide a filament tow having a total denier of 4,000,000. The filament tow was drawn at a draw ratio of 3.0 in hot water at a temperature of 70° C. The drawn filaments were crimped by a crimper, heat-relaxed at a temperature of 120° C. for 30 minutes and then cut at a length of 51 mm.

The resultant individual composite staple fibers had a denier of 6.0 and a crimp number of 10 crimps/25 mm.

Separately, a polyethylene terephthalate resin having an intrinsic viscosity of 0.64 was melted at a temperature of 280° C. and extruded through melt-spinning orifices for hollow filaments in an usual manner. The resultant undrawn filaments were drawn, crimped and cut in an usual manner, to provide polyester hollow staple fibers having a denier of 6.0, a length of 51 mm, and a crimp number of 10 crimps/25 mm. A staple fiber blend was prepared by blending 50 parts by weight of the above-mentioned fragrant non-hollow core-in-sheath type composite staple fibers with 50 parts by weight of the polyester hollow staple fibers, and converted to webs by carding the blend. The webs were stuffed into a covering cloth made from a cotton spun yarn plain weave having an air permeability of 35 ml/cm$^2$·sec under the ambient atmosphere pressure, to provide a thick bedquilt having a weight of 1800 g.

This fragrant thick bedquilt was used in a bed room having an area of about 10 m$^2$. It was confirmed that the bed room was filled by a forest-like fragrance and had a comfortable atmosphere.

This fragrant thick bedquilt was effective for imparting a deep sleep, a comfortable waking up, a pleasurable feeling, and a mental stability to the human body.

Even during the summer season having a high temperature and high humidity, the fragrant thick bedquilt did not allow acari to live and breed therein. Also, it was confirmed that, when the fragrant thick bedquilt was subjected to dry cleaning, the fragrance thereof was substantially not reduced. Also, even two years after the production of the fragrant thick bedquilt, the fragrance thereof was substantially similar to the initial fragrance thereof.

The constitution of the non-hollow core-in-sheath type composite staple fibers is indicated in Table 1.

Also, the composition of the staple fiber blend and the test results are shown in Table 2.

EXAMPLES 2 TO 13 AND COMPARATIVE EXAMPLES 1 TO 8

In each of Examples 2 to 13 and Comparative Examples 1 to 8, the same procedures as in Example 1 were carried out except that the amount of Hinoki essential oil, the type and amount of the polyethylene blend for the core portion, the type of the polyester resin for the sheath portion, the weight ratio of the core portion to the sheath portion, the cross-sectional profile, length, denier and crimp number of the composite staple fibers, were as indicated in Table 1, and the composition of the staple fiber blend and the test results are as shown in Table 2.

TABLE 1

| | | | Example No. | | | | | | | | | | |
|---|---|---|---|---|---|---|---|---|---|---|---|---|---|
| | | | Example | | Comparative Example | | | | Example | Comparative Example | | Example | |
| Item | | | 1 | 2 | 1 | 2 | 3 | 4 | 3 | 5 | 6 | 4 | 5 |
| Fragrant | Core | Content of Hinoki | 1 | 3 | 7 | 1 | 1 | 1 | 1 | 1 | 1 | 1 | 1 |

TABLE 1-continued

| | | | | | | | | | | | | | |
|---|---|---|---|---|---|---|---|---|---|---|---|---|---|
| core-in-sheath type composite staple fiber | | oil (wt %) | | | | | | | | | | | |
| | | Content of high density polyethylene (wt %) | 95 | 85 | 65 | 99 | 40 | 95 | 95 | 95 | 95 | 95 | 95 |
| | | Content of ethylene-vinyl acetate copolymer (wt %) | | | | | | | | | | | |
| | | Polymerization 84:16 | 4 | 12 | 28 | — | 59 | 1 | 4 | 4 | 4 | 4 | 4 |
| | | wt ratio 60:40 | — | — | — | — | — | 4 | — | — | — | — | — |
| | Sheath | Polyethylene terephthalate (wt %) | 100 | 100 | 100 | 100 | 100 | 100 | — | — | 100 | 100 | 100 |
| | | Polybutylene terephthalate (wt %) | — | — | — | — | — | — | 100 | — | — | — | — |
| | | Polypropylene (wt %) | — | — | — | — | — | — | — | 100 | — | — | — |
| | Core/sheath weight ratio | | 50/50 | 50/50 | 50/50 | 50/50 | 50/50 | 65/35 | 65/35 | 65/35 | 50/50 | 50/50 | 50/50 |
| | Cross-sectional profile (*)1 | | A | A | A | A | A | A | A | A | B | A | A |
| | Denier | | 6 | 6 | 6 | 6 | 6 | 6 | 6 | 6 | 6 | 6 | 6 |
| | Length (mm) | | 51 | 51 | 51 | 51 | 51 | 51 | 51 | 51 | 51 | 35 | 70 |
| | Crimp number (crimps/25 mm) | | 10 | 10 | 10 | 10 | 10 | 10 | 10 | 10 | 10 | 10 | 10 |

| | | | Example No. | | | | | | | | | |
|---|---|---|---|---|---|---|---|---|---|---|---|---|
| | | | Example | | | | | Comparative Example | Example | | | Comparative Example |
| Item | | | 6 | 7 | 8 | 9 | 10 | 7 | 11 | 12 | 13 | 8 |
| Fragrant core-in-sheath type composite staple fiber | Core | Content of Hinoki oil (wt %) | 1 | 1 | 1 | 1 | 1 | 1 | 1 | 1 | 1 | 1 |
| | | Content of high density polyethylene (wt %) | 95 | 95 | 95 | 95 | 95 | 95 | 95 | 95 | 95 | 95 |
| | | Content of ethylene-vinyl acetate copolymer (wt %) | | | | | | | | | | |
| | | Polymerization 84:16 | 4 | 4 | 4 | 4 | 4 | 4 | 4 | 4 | 4 | 4 |
| | | wt ratio 60:40 | — | — | — | — | — | — | — | — | — | — |
| | Sheath | Polyethylene terephthalate (wt %) | 100 | 100 | 100 | 100 | 100 | 100 | 100 | 100 | 100 | 100 |
| | | Polybutylene terephthalate (wt %) | — | — | — | — | — | — | — | — | — | — |
| | | Polypropylene (wt %) | — | — | — | — | — | — | — | — | — | — |
| | Core/sheath weight ratio | | 50/50 | 50/50 | 50/50 | 50/50 | 50/50 | 50/50 | 50/50 | 50/50 | 50/50 | 50/50 |
| | Cross-sectional profile (*)1 | | A | A | A | A | A | A | A | A | A | A |
| | Denier | | 6 | 0.3 | 60 | 6 | 6 | 6 | 6 | 6 | 6 | 6 |
| | Length (mm) | | 51 | 51 | 51 | 51 | 51 | 51 | 51 | 51 | 51 | 51 |
| | Crimp number (crimps/25 mm) | | 10 | 15 | 8 | 4 | 35 | 10 | 10 | 10 | 10 | 10 |

Note:
(*)1A . . . Concentric circular non-hollow core and sheath
B . . . concentric circular hollow core and sheath

TABLE 2

| | | | Example No. | | | | | | | | | | |
|---|---|---|---|---|---|---|---|---|---|---|---|---|---|
| | | | Example | | Comparative Example | | | | Example | Comparative Example | | Example | |
| Item | | | 1 | 2 | 1 | 2 | 3 | 4 | 3 | 5 | 6 | 4 | 5 |
| Composition of staple fiber blend | Fragrant composite staple fiber (wt %) | | 50 | 50 | 50 | 50 | 50 | 50 | 50 | 50 | 50 | 50 | 50 |
| | Heat-bonding staple fiber (*)2 (wt %) | | — | — | — | — | — | — | — | — | — | — | — |
| | Polyethylene terephthalate staple fiber (wt %) | | 50 | 50 | 50 | 50 | 50 | 50 | 50 | 50 | 50 | 50 | 50 |
| | Natural fibers (wt %) | Wool | — | — | — | — | — | — | — | — | — | — | — |
| | | Cotton | — | — | — | — | — | — | — | — | — | — | — |
| Property of textile material (wadding) | Durability of fragrance | Initial | 5 | 5 | (*)3 | 5 | 3 | 2 | 5 | 5 | 5 | 5 | 5 |
| | | After dry cleaning | 5 | 5 | — | 3 | 3 | 2 | 5 | 5 | 3 | 5 | 5 |
| | | One year after | 4 | 5 | — | 1 | 3 | 2 | 4 | 3 | 2 | 4 | 5 |
| | | Two years after | 4 | 4 | — | 1 | 3 | 2 | 4 | 2 | 1 | 4 | 4 |
| | Bulkiness | Specific volume | 118 | 119 | — | 118 | 117 | 107 | 114 | 95 | 126 | 115 | 116 |
| | | Bulkiness reduction (%) | 7 | 7 | — | 7 | 7 | 10 | 8 | 10 | 20 | 8 | 6 |

TABLE 2-continued

| | | | | | | | | | | | | |
|---|---|---|---|---|---|---|---|---|---|---|---|---|
| | Acaricide effect(*)4 | Initial | a | a | — | a | b | b | a | a | a | a | a |
| | | Two years after | a | a | — | b | b | b | a | b | b | a | a |
| | General evaluation(*)5 | | Go | Go | Ba | Ba | Ba | Ba | Go | Ba | Ba | Go | Go |

| Item | | | Example No. | | | | | | | | | |
|---|---|---|---|---|---|---|---|---|---|---|---|---|
| | | | Example | | | | | Comparative Example | Example | | | Comparative Example |
| | | | 6 | 7 | 8 | 9 | 10 | 7 | 11 | 12 | 13 | 8 |
| Composition of staple fiber blend | Fragrant composite staple fiber (wt %) | | 20 | 70 | 70 | 70 | 70 | 5 | 70 | 50 | 50 | — |
| | Heat-bonding staple fiber (*)2 (wt %) | | — | — | — | — | — | — | 30 | 30 | 30 | — |
| | Polyethylene terephthalate staple fiber (wt %) | | 80 | 30 | 30 | 30 | 30 | 95 | — | — | — | — |
| | Natural fibers (wt %) | Wool | — | — | — | — | — | — | — | 20 | — | — |
| | | Cotton | — | — | — | — | — | — | — | — | 30 | 100 |
| Property of textile material (wadding) | Durability of fragrance | Initial | 5 | 5 | 5 | 5 | 5 | 3 | 5 | 5 | 5 | 1 |
| | | After dry cleaning | 4 | 5 | 5 | 5 | 5 | 3 | 5 | 5 | 5 | — |
| | | One year after | 4 | 5 | 5 | 5 | 5 | 2 | 5 | 4 | 4 | — |
| | | Two years after | 4 | 4 | 4 | 4 | 4 | 2 | 4 | 4 | 4 | — |
| | Bulkiness | Specific volume | 123 | 98 | 100 | 96 | 99 | 125 | 113 | 106 | 108 | 82 |
| | | Bulkiness reduction (%) | 6 | 9 | 8 | 9 | 8 | 6 | 2 | 3 | 5 | 24 |
| | Acaricide effect(*)4 | Initial | a | a | a | a | a | b | a | a | a | b |
| | | Two years after | a | a | a | a | a | b | a | a | a | — |
| | General evaluation(*)5 | | Go | Go (*)6 | Go (*)7 | Go (*)7 | Go (*)6 | Ba | Go | Go | Go | Ba |

Note:
(*)2Core: polyethylene terephthalate, Sheath: Amorphous copolyester
(*)3Bad odor
(*)4a . . . satisfactory, b . . . unsatisfactory
(*)5Go . . . good, Ba . . . Bad
(*)6In carding step, a small number of neps were formed in the resultant webs.
(*)7In carding step, the resultant webs were sometimes broken.

EXAMPLES 14 TO 19

In each of Examples 14 to 19, the same procedures as in Example 1 were carried out except that the type of essential oil, and the type of modified polyethylene copolymer were as indicated in Table 3.

The test results are shown in Table 3.

EXAMPLES 20

The same non-hollow composite staple fiber-producing procedures as in Example 1 were carried out except that the denier of the resultant staple fibers was 1.5, the length of the staple fibers was 38 mm, and the crimp number of the staple fibers was 13 crimps/25 mm.

TABLE 3

| Item | | | | Example No. Example | | | | | |
|---|---|---|---|---|---|---|---|---|---|
| | | | | 14 | 15 | 16 | 17 | 18 | 19 |
| Fragrant core-in-sheath type composite staple fiber | Core | Natural essential oil (wt %) | | Eucalyptus oil | Peppermint oil | Camphor oil | Hiba oil | Hinoki oil | Hinoki oil |
| | | Synthetic essential oil(*)8 (wt %) | | — | — | — | — | 0.6% | 0.95% |
| | | High density polyethylene (wt %) | | 95 | 95 | 95 | 95 | 95 | 95 |
| | | Modified ethylene copolymer | Types of monomers | Ethylene/vinyl acetate | Ethylene/vinyl acetate | Ethylene/maleic anhydride | Ethylene/ethyl acrylate | Ethylene/vinyl acetate | Ethylene/vinyl acetate |
| | | | Copolymerization weight ratio | 95/5 | 72/28 | 85/15 | 85/15 | 84/16 | 84/16 |
| | | | Amount (wt %) | 4 | 4 | 4 | 4 | 4 | 4 |
| | Sheath | Polyethylene terephthalate (wt %) | | 100 | 100 | 100 | 100 | 100 | 100 |
| Property of textile material | Durability of fragrance | Initial | | 5 | 5 | 5 | 5 | 5 | 5(*)9 |
| | | After dry cleaning | | 5 | 5 | 5 | 5 | 5 | 5(*)9 |
| | | One year after | | 4 | 4 | 4 | 4 | 4 | 4(*)9 |
| | | Two years after | | 4 | 4 | 4 | 4 | 4 | 4(*)9 |
| | Bulkiness | Specific volume | | 115 | 117 | 116 | 115 | 115 | 115 |
| | | Bulkiness retention (%) | | 7 | 7 | 7 | 7 | 7 | 7 |
| | General evaluation | | | Good | Good | Good | Good | Good | Good(*)9 |

Note:
(*)8This synthetic essential oil comprised, as main components, α-pinene and limonene
(*)9The resultant smell was slightly unnatural.

The resultant fragrant composite staple fibers were blended with cotton fibers in a blend weight ratio of 60:40. The fiber blend was converted to spun yarns having a cotton yarn count of 45 and then to a plain weave fabric having a basis weight of 100 g/m$^2$. A thick bedquilt was produced by stuffing 1800 g of the same fiber blend of 30 parts by weight of the same fragrant non-hollow core-in-sheath composite staple fibers as in Example 1, with 70 parts by weight of the same polyethylene terephthalate staple fibers as in Example 1, into a covering cloth made from the above-mentioned plain weave. This covering cloth had an air-permeability of 30 ml/cm$^2$·sec.

The resultant thick bedquilt was used under the same conditions as in Example 1. The same fragrant effect as in Example 1 was obtained. Also, it was confirmed that the fragrance of the bedquilt was maintained at a satisfactory level even after using same for two years.

EXAMPLE 21

The same procedures as in Example 20 were carried out except that, in the fragrant covering cloth, the blend weight ratio of the non-hollow core-in-sheath type composite staple fibers to the cotton fibers was 60:40 and the resultant plain weave was calendared to reduce the air permeability thereof to 8 ml/cm$^2$·sec.

It was confirmed that the durability of the fragrance of the resultant thick bedquilt was slightly enhanced in comparison with that of Example 20.

EXAMPLE 22

Fragrant non-hollow core-in-sheath type composite staple fibers were produced in the following manner.

A blend of (1) 5 parts by weight of pellets consisting of 20% by weight of a Hinoki essential oil and 80% by weight of an ethylene-vinyl acetate copolymer of 84% by weight of ethylene with 16% by weight of vinyl acetate, with (2) 95 parts by weight of pellets consisting of a high density polyethylene having a melt flow index of 20, was prepared.

A non-hollow core-in-sheath type composite filaments were produced by a core-in-sheath type filament-melt spinning apparatus by forming the core portion from the pellet blend method at a temperature of 250° C. and forming a sheath portion from a polyethylene terephthalate resin having an intrinsic viscosity of 0.64 determined in a concentration of 1.2 g/100 ml in o-chlorophenol solvent at a temperature of 35° C., and melted at a temperature of 280° C.

In the core-in-sheath type filament melt-spinning apparatus, the melt-spinneret had 260 spinning circular orifices each having an inside diameter of 0.5 mm.

The polyethylene blend and polyethylene terephthalate melts were extruded through the spinneret and taken up at a speed of 800 m/min.

The core portion and the sheath portion had a weight ratio of 35:65. The resultant composite filaments were substantially not fragrant. The resultant undrawn composite filaments were bundled to provide a filament tow having a total denier of 4,000,000. The filament tow was drawn at a draw ratio of 3.0 in hot water at a temperature of 70° C. The drawn filaments were heat-relaxed at a temperature of 120° C. for 30 minutes and then cut at a length of 10 mm.

The resultant individual composite staple fibers had a denier of about 2, and exhibited a fragrance.

The fragrant composite staple fibers were suspended in an amount of 70 parts by weight together with 15 parts by dry solid weight of a rubber latex (available under the trademark of Unipol LX204, from Nihon Zeon) and 15 parts by dry solid weight of wood pulp (NBS pulp made by Sanyo Kokusaku Pulp K.K.) in 200,000 parts by weight of water. The resultant fiber slurry was mixed with 0.5 parts by weight of aluminum sulfate and the pH of the slurry was adjusted to 4.5.

The slurry was subjected to a wet paper-forming process to produce a paper-like sheet having a basis weight of 25 g/m$^2$. The resultant fragrant paper-like sheet was employed to form sliding paper doors for a Japanese room. It was confirmed that the resultant sliding paper doors maintained a satisfactory fragrance for at least one year.

The test results are shown in Table 4.

EXAMPLES 23 TO 27 AND COMPARATIVE EXAMPLES 9 TO 15

In each of Examples 23 to 27 and Comparative Examples 9 to 15, the same procedures as in Example 22 were carried out except that the content of the Hinoki essential oil, the type and amount of the core-forming polyethylene, the type and copolymerization weight ratio of the core-forming modified ethylene copolymer, the type of the sheath-forming polyester, the core/sheath weight ratio and the cross-sectional profile and length of the composite staple fibers were changed as indicated in Table 4.

The test results are shown in Table 4.

TABLE 4

| | | | | Example No. | | | | | | |
|---|---|---|---|---|---|---|---|---|---|---|
| | | | | Example | | Comparative Example | | | | Example |
| Item | | | | 22 | 23 | 9 | 10 | 11 | 12 | 24 |
| Fragrant core-in-sheath type composite staple fiber | Core | Hinoki essential oil (wt %) | | 1 | 3 | 7 | 1 | 1 | 1 | 1 |
| | | High density polyethylene (wt %) | | 95 | 85 | 65 | 99 | 40 | 95 | 95 |
| | | Ethylene-vinyl acetate copolymer (wt %) | Copolymerization ratio (weight) of ethylene to vinyl acetate 84/10 | 4 | 12 | 28 | — | 59 | — | 4 |
| | | | 60/40 | — | — | — | — | — | 4 | — |
| | Sheath | Polyethylene terephthalate | | 100 | 100 | 100 | 100 | 100 | 100 | — |
| | | Polybutylene terephthalate | | — | — | — | — | — | — | 100 |
| | | Polypropylene | | — | — | — | — | — | — | — |
| | Core/sheath weight ratio | | | 35/65 | 35/65 | 35/65 | 35/65 | 35/65 | 65/35 | 65/35 |
| | Cross-sectional profile(*)$_1$ | | | A | A | A | A | A | A | A |
| | Fiber length (mm) | | | 10 | 10 | 10 | 10 | 10 | 10 | 10 |
| | Spinnability of core/sheath(*)$_{10}$ | | | 5 | 5 | 1 | 2 | 4 | 4 | 5 |
| | Dispensibility of staple fibers in water(*)$_{10}$ | | | 5 | 5 | 5 | 5 | 5 | 5 | 5 |
| Durability of | At preparation of composite staple fibers | | | 5 | 5 | (*)$_{11}$ | 5 | 3 | 2 | 5 |
| | At preparation of paper-like sheet | | | 5 | 5 | — | 4 | 3 | 2 | 5 |

TABLE 4-continued

| fragrance | One year after sheet preparation | | | | 4 | 5 | — | 1 | 3 | 2 | 4 |
|---|---|---|---|---|---|---|---|---|---|---|---|
| | | | | | Example No. | | | | | | |
| | | | | | Comparative Example | | | Example | | | |
| Item | | | | | 13 | 14 | 15 | 25 | 26 | 27 | |
| Fragrant core-in-sheath type composite staple fiber | Core | Hinoki essential oil (wt %) | | | 1 | 1 | 1 | 1 | 1 | 1 | |
| | | High density polyethylene (wt %) | | | 95 | 95 | 95 | 95 | 95 | 95 | |
| | | Ethylene-vinyl acetate copolymer (wt %) | Copolymerization ratio (weight) of ethylene to vinyl acetate | 84/10 | 4 | 4 | 4 | 4 | 4 | 4 | |
| | | | | 60/40 | — | — | — | — | — | — | |
| | Sheath | Polyethylene terephthalate | | | — | 100 | 100 | 100 | 100 | 100 | |
| | | Polybutylene terephthalate | | | — | — | — | — | — | — | |
| | | Polypropylene | | | 100 | — | — | — | — | — | |
| | Core/sheath weight ratio | | | | 65/35 | 35/65 | 35/65 | 35/65 | 35/65 | 35/65 | |
| | Cross-sectional profile(*)$_1$ | | | | A | B | A | A | A | A | |
| | Fiber length (mm) | | | | 10 | 10 | 2 | 5 | 25 | 35 | |
| | Spinnability of core/sheath(*)$_{10}$ | | | | 5 | 5 | 5 | 5 | 5 | 5 | |
| | Dispensibility of staple fibers in water(*)$_{10}$ | | | | 5 | 5 | 2 | 5 | 5 | 2 | |
| Durability of fragrance | At preparation of composite staple fibers | | | | 5 | 5 | 5 | 5 | 5 | 4 | |
| | At preparation of paper-like sheet | | | | 5 | 3 | 5 | 5 | 5 | 4 | |
| | One year after sheet preparation | | | | 2 | 2 | 1 | 4 | 4 | 4 | |

Note:
(*)$_{10}$5 . . . Excellent, 4 . . . Good, 3 . . . Satisfactory, 2 . . . Bad, 1 . . . Very bad
(*)$_{11}$Bad odor

EXAMPLE 28

Fragrant non-hollow core-in-sheath type composite staple fibers were produced in the following manner.

A blend of (1) 5 parts by weight of pellets consisting of 20% by weight of a Hinoki essential oil and 80% by weight of a ethylene-vinyl acetate copolymer of 84% by weight of ethylene with 16% by weight of vinyl acetate, with (2) 95 parts by weight of pellets consisting of a high density polyethylene having a melt flow index of 20, was prepared.

A non-hollow core-in-sheath type composite filaments were produced by using a core-in-sheath type filament-melt spinning apparatus by forming the core portion from the pellet blend method at a temperature of 250° C. and forming a sheath portion from a polyethylene terephthalate resin having an intrinsic viscosity of 0.64 determined in a concentration of 1.2 g/100 ml in o-chlorophenol solvent at a temperature of 35° C., and melted at a temperature of 280° C.

In the core-in-sheath type filament melt-spinning apparatus, the melt-spinneret had 450 spinning circular orifices each having an inside diameter of 0.5 mm.

The polyethylene blend and polyethylene terephthalate melts were extruded through the spinneret and taken up at a speed of 1000 m/min.

The core portion and the sheath portion had a weight ratio of 50:50. The resultant undrawn composite filaments were bundled to provide a filament tow having a total denier of 3,000,000. The filament tow was drawn at a draw ratio of 2.5 in hot water at a temperature of 70° C. The undrawn filaments and the drawn filaments were substantially not fragrant. The drawn filaments were crimped by using a stuffing box, heat-treated at a temperature of 120° C. for 30 minutes and then cut at a length of 51 mm.

The resultant individual composite staple fibers had a denier of about 2.0 and a crimp number of 13 crimps/25 mm and were fragrant.

The fragrant composite staple fibers were blended with non-fragrant polyethylene terephthalate staple fibers having a denier of 2 in a blending weight ratio of 50:50, and the resultant fiber blend was converted to spun yarns by a usual spinning process.

The blended spun yarns were dyed with a disperse dye at a temperature of 130° C. under a high pressure, and the dyed spun yarns were converted to a plain weave having a basis weight of 200 g/m$^2$.

The plain weave was formed into a curtain having a length of 180 cm and a width of 160 cm.

The durability of fragrance of the curtain was evaluated in the above-mentioned manner.

The test results are shown in Table 5.

EXAMPLES 29 TO 34 AND COMPARATIVE EXAMPLE 16 TO 21

In each of Examples 29 to 34 and Comparative Examples 16 to 21, the same procedures as in Example 28 were carried out except that the content of the Hinoki essential oil, the type and blend weight ratio of core-forming polymer, the type of sheath-forming polymer, the weight ratio of the core to sheath, the cross-sectional profile and length of the fragrant staple fibers, and the blend weight ratio of the fragrant staple fibers to the non-fragrant staple fibers were as shown in Table 5.

The test results are shown in Table 5.

TABLE 5

| | | | | | Example No. | | | | | | |
|---|---|---|---|---|---|---|---|---|---|---|---|
| | | | | | Example | | Comparative Example | | | | Example |
| Item | | | | | 28 | 29 | 16 | 17 | 18 | 19 | 30 |
| Fragrant core-in-sheath type composite | Core | Hinoki essential oil (wt %) | | | 1 | 3 | 7 | 1 | 1 | 1 | 1 |
| | | High density polyethylene (wt %) | | | 95 | 85 | 65 | 99 | 40 | 95 | 95 |
| | | Ethylene-vinyl acetate copolymer | Ethylene/vinyl acetate weight ratio | 84/16 | 4 | 12 | 28 | — | 59 | — | 4 |
| | | | | 60/40 | — | — | — | — | — | 4 | — |

TABLE 5-continued

| | | | | | | | | | |
|---|---|---|---|---|---|---|---|---|---|
| staple | | (wt %) | | | | | | | |
| fiber | Sheath | Polyethylene terephthalate (wt %) | 100 | 100 | 100 | 100 | 100 | 100 | — |
| | | Polybutylene terephthalate (wt %) | — | — | — | — | — | — | 100 |
| | | Polypropylene (wt %) | — | — | — | — | — | — | — |
| | Core/sheath weight ratio | | 50/50 | 50/50 | 50/50 | 50/50 | 50/50 | 65/35 | 65/35 |
| | Cross-sectional profile(*)$_1$ | | A | A | A | A | A | A | A |
| | Fiber length (mm) | | 51 | 51 | 51 | 51 | 51 | 51 | 51 |
| Fiber | Fragrant staple fiber (wt %) | | 50 | 50 | 50 | 50 | 50 | 50 | 50 |
| blend | Non-fragrant staple fiber (wt %) | | 50 | 50 | 50 | 50 | 50 | 50 | 50 |
| Durability | Initial | | 5 | 5 | (*)$_{11}$ | 5 | 3 | 2 | 5 |
| of | After cleaning | | 5 | 5 | — | 2.5 | 2.5 | 2 | 4.5 |
| fragrance | One year after | | 4 | 4 | — | 1 | 2.5 | 2 | 4 |
| | Two years after | | 4 | 4 | — | 1 | 2.5 | 2 | 4 |

| | | | | | | | | | |
|---|---|---|---|---|---|---|---|---|---|
| | | | | Example No. | | | | | |
| | | | | Comparative Example | | Example | | | |
| Item | | | | 20 | 21 | 31 | 32 | 33 | 34 |
| Fragrant | Core | Hinoki essential oil (wt %) | | 1 | 1 | 1 | 1 | 1 | 1 |
| core-in- | | High density polyethylene (wt %) | | 95 | 95 | 95 | 95 | 95 | 95 |
| sheath | | Ethylene-vinyl acetate copolymer (wt %) | Ethylene/vinyl acetate weight ratio 84/16 | 4 | 4 | 4 | 4 | 4 | 4 |
| type | | | 60/40 | — | — | — | — | — | — |
| composite | | | | | | | | | |
| staple | | | | | | | | | |
| fiber | Sheath | Polyethylene terephthalate (wt %) | | — | 100 | 100 | 100 | 100 | 100 |
| | | Polybutylene terephthalate (wt %) | | — | — | — | — | — | — |
| | | Polypropylene (wt %) | | 100 | — | — | — | — | — |
| | Core/sheath weight ratio | | | 65/35 | 50/50 | 50/50 | 50/50 | 50/50 | 50/50 |
| | Cross-sectional profile(*)$_1$ | | | A | B | A | A | A | A |
| | Fiber length (mm) | | | 51 | 51 | 35 | 70 | 51 | 51 |
| Fiber | Fragrant staple fiber (wt %) | | | 50 | 50 | 50 | 50 | 35 | 15 |
| blend | Non-fragrant staple fiber (wt %) | | | 50 | 50 | 50 | 50 | 65 | 85 |
| Durability | Initial | | | 4.5 | 5 | 5 | 4.5 | 4.5 | 4 |
| of | After cleaning | | | 4.5 | 2.5 | 4.5 | 4.5 | 4 | 3.5 |
| fragrance | One year after | | | 2.5 | 2 | 4 | 4 | 4 | 3 |
| | Two years after | | | 2 | 1 | 4 | 4 | 4 | 3 |

We claim:

1. A fragrant non-hollow core-in-sheath type composite staple fiber having a length of from 3 mm to 150 mm and comprising:

(1) a non-hollow core portion comprising (i) 0.1 to 5%, based on the total weight of the core portion, of an essential oil and (ii) the balance consisting of an olefin polymer composition; and (2) a sheath portion covering the core portion and comprising a polyester resin, the olefin polymer composition (ii) comprising:

(A) 50 to 98% by weight of an olefin polymer which is a polymerization product of at least one member selected from the group consisting of ethylene and α-olefins, and free from polar radicals; and (B) 2 to 50% by weight of a modified olefin polymer that is a copolymerization product of (a) 70 to 97% by weight of at least one olefin with (b) 3 to 30% by weight of at least one ethylenically unsaturated polar monomer selected from the group consisting of ethylenically unsaturated carboxylic acids, ethylenically unsaturated alcohols, ethylenically unsaturated esters, and anhydrides and amides of the above-mentioned carboxylic acids and uniformly blended with the olefin polymer (A).

2. The fragrant non-hollow core-in-sheath type composite staple fiber as claimed in claim 1, wherein the essential oil (i) comprises at least one natural fragrant oil selected from the group consisting of Hinoki oil, peppermint oil, eucalyptus oil, Hiba oil and camphor oil.

3. The fragrant non-hollow core-in-sheath type composite staple fiber as claimed in claim 1, wherein the α-olefins of the olefin polymer (A) is selected from the group consisting of propylene, butene-1, and hexene-1.

4. The fragrant non-hollow core-in-sheath type composite staple fiber as claimed in claim 1, wherein the olefin polymer (A) is selected from the group consisting of high density polyethylenes, middle density polyethylenes and low density polyethylenes.

5. The fragrant non-hollow core-in-sheath type composite staple fiber as claimed in claim 1, wherein the olefin (a) of the modified olefin polymer (B) is selected from the group consisting of ethylene, propylene, butene-1 and hexene-1.

6. The fragrant non-hollow core-in-sheath type composite staple fiber as claimed in claim 1, wherein the ethylenically unsaturated polar monomer (b) of the modified olefin polymer (B) is selected from the group consisting of acrylic acid, methacrylic acid, maleic acid, fumaric acid, lower alkyl esters and amides of the above-mentioned acids, maleic anhydride and vinyl acetate.

7. The fragrant non-hollow core-in-sheath type composite staple fiber as claimed in claim 1, wherein the modified olefin polymer (B) is an ethylene-vinyl acetate copolymer.

8. The fragrant non-hollow core-in-sheath type composite staple fiber as claimed in claim 1, having a denier of 0.5 to 50.

9. The fragrant non-hollow core-in-sheath type composite staple fiber as claimed in claim 1, wherein the core portion and the sheath portion are in a weight ratio of from 80/20 to 20/80.

10. A gradual fragrance-emitting textile material containing at least 10% by weight of the fragrant non-hollow core-in-sheath type composite staple fiber as claimed in claim 1.

11. The gradual fragrance-emitting textile material as claimed in claim 10, which is in the form of fiber wadding and in which each composite staple fiber has a weight ratio of the core portion to the sheath portion of from 20/80 to 80/20, a denier of 0.5 to 50, a length of 30 to 100 mm and a crimp number of 6 to 30 crimps/25 mm.

12. The gradual fragrance-emitting textile material as claimed in claim 11, in which the fiber wadding further comprises at least 10% by weight of heat-bonding staple fibers.

13. The gradual fragrance-emitting textile material as claimed in claim 10, wherein the fiber wadding is covered by a cover cloth.

14. The gradual fragrance-emitting textile material as claimed in claim 10, which is in the form of a paper-like sheet and in which each composite staple fiber has a weight ratio of the core portion to the sheath portion of from 20/80 to 80/20, a denier of 0.5 to 15 and a length of from 3 to 30 mm and is substantially free from crimps.

15. The gradual fragrance-emitting textile material as claimed in claim 10, which is in the form of a woven or knitted fabric and in which each composite staple fiber has a weight ratio of the core portion to the sheath portion of 20/80 to 80/20, a denier of 0.5 to 50, a length of 30 to 100 mm, and a crimp number of 6 to 30 crimps/25 mm.

16. The gradual fragrance-emitting textile material as claimed in claim 15, wherein the woven or knitted fabric is used as a cover cloth for covering a fiber wadding.

* * * * *